US005322120A

United States Patent [19]

Bøe et al.

[11] Patent Number: 5,322,120

[45] Date of Patent: Jun. 21, 1994

[54] ELECTRO HYDRAULIC DEEP WELL SAMPLING ASSEMBLY

[75] Inventors: Einar Bøe, Notodden; Stig Holgersen, Hinna; Hans Paul Carlsen, Notodden; Ingvar Stange; Carl Bastiansen, both of Dalen, all of Norway

[73] Assignee: Norsk Hydro a.s., Oslo, Norway

[21] Appl. No.: 962,184

[22] PCT Filed: Apr. 29, 1992

[86] PCT No.: PCT/NO92/00083

§ 371 Date: Dec. 28, 1992

§ 102(e) Date: Dec. 28, 1992

[87] PCT Pub. No.: WO92/19842

PCT Pub. Date: Nov. 12, 1992

[30] Foreign Application Priority Data

May 3, 1991 [NO] Norway ..... 911756

[51] Int. Cl.[5] ..... E21B 49/00

[52] U.S. Cl. ..... 166/264

[58] Field of Search ..... 166/264, 250, 323; 175/59, 233-236

[56] References Cited

U.S. PATENT DOCUMENTS

| | | | |
|---|---|---|---|
| 2,645,289 | 7/1953 | Leas . | |
| 3,033,286 | 5/1962 | Fast et al. . | |
| 4,215,746 | 8/1980 | Hallden et al. . | |
| 4,583,595 | 4/1986 | Czernichow et al. . | |
| 4,636,934 | 1/1987 | Schwendemann et al. . | |
| 4,846,364 | 7/1989 | Bøe . | |
| 4,856,585 | 8/1989 | White et al. | 166/264 X |
| 4,884,439 | 12/1989 | Baird | 166/264 X |
| 4,896,722 | 1/1990 | Upchurch | 166/264 |
| 4,903,765 | 2/1990 | Zunkel | 166/264 X |

FOREIGN PATENT DOCUMENTS 0456581 11/1991 European Pat. Off. .

*Primary Examiner*—Thuy M. Bui

*Attorney, Agent, or Firm*—Wenderoth, Lind & Ponack

[57] ABSTRACT

A device for deep well sampling when drilling for, or production of, oil and gas, includes a chamber for receiving samples and a valve for opening and closing such chamber. The device includes a hydraulic system for operating the valve. The hydraulic system, a control panel and control of the sampling device are operated by an electric system located in the panel from which signals are sent via a combined lifting and electric conducting cable.

9 Claims, 3 Drawing Sheets

ELECTRO HYDRAULIC DEEP WELL SAMPLING ASSEMBLY

BACKGROUND OF THE INVENTION

The present invention relates to deep well sampling when drilling offshore for oil or gas and also for extracting production thereof. The invention includes a sampling device immersed into a drilled hole and which, at certain depths, takes samples of liquid and gas. When drilling for and production of hydrocarbons, it is important to take samples in the drill hole in order to detect the presence of gas and liquid traces. This is done by immersing a deep well sampler device into the drill hole. A container, in the sampling device, collects samples of what may be gas or liquid and is hoisted to a surface vessel. Such samples then are emptied into a transport container for laboratory analysis where the different characterizations of the substances in the samples are determined.

There exist known sampling devices described in U.S. Pat. No. 4,583,595 where a collecting sampler container for gas and liquid in a drill hole includes a piston device in order to separate physically the sample from substances which will blur the laboratory results. Such a substance may be a counter pressure substance used to regulate the collecting container level. During sampling the counter pressure substance is pressed out of the collecting container. The gas/liquid sample will, at the same time as the counter pressure substance is pressed out of the container, enter the container on the other side of the piston. An alternative to such container and piston is to furnish the sampling device with a compressible lead pipe as described in Norwegian patent application No 895,139. However, this sampler device comprises a pipe formed as a cylinder with two chambers separated by a compressible lead pipe. In addition, such device has a cylinder formed outer pipe which has therein a unit which forms a gastight collecting chamber for the gas/liquid sample and a chamber for the counter pressure substance. The chamber for the counter pressure substance is formed when the lead pipe is compressed and is pressing against the inner side of the U-shaped member. When filling the chamber the gas/liquid sample will move to the other side of the lead pipe and press this outwards. The volume of the chamber for the counter pressure substance will thus be reduced by the same amount as the increase in the sample chamber.

SUMMARY OF THE INVENTION

This invention is based on a further development of the device of Norwegian patent application No. 895,139. When developing such previous invention, the need for developing a steering or control and logging system connected to the sampler device was recognized. Known systems either apply time (PID on/off) for opening valves to fill the sample chamber, or send an electrical impulse (signal) to detonate a small explosive in order to open a front of the sampler to enable gas/liquid to stream into the chamber. Both methods have disadvantages. By time steering or control one is dependent on reaching a correct depth in a certain amount of time. This depends on problems that may be confronted when immersing the sampler device into the drilled hole, and also a complicated question mechanically. Use of explosives to open the front of the sampler device limits the use of logging instruments due to vibrations and/or functions of the sampler can be damaged.

Thus, the object of the present invention is to provide a sampling assembly which is not encumbered with the above mentioned disadvantages, is reliable when filling and where application of electronic logging of parameters such as pressure, temperature, permeability and depth is preferable and made possible.

The present invention includes a steering or control panel having a printer for control, reading and steering logging instrumentation. All data is stored in the panel, and valves on a sampling device are controlled from the panel. The control panel is connected with the sampler device by a joist wire with a core of copper for electronic communication between the panel and the sampling device. The sampling device includes a top part for connection to the wire, a chamber for electronic equipment, a depth measuring device, pressure and temperature instruments and a permeability measuring device in order to establish whether the sampling device is in contact with gas or liquid. A valve, e.g. a servo valve, regulated by an electric device, activates a hydraulic system which in turn actuates and controls the opening and closing of a slide valve in order to open or close a collecting chamber for obtaining a sample of gas or liquid.

The equipment of the assembly thus is operated electronically and hydraulically. The hydraulic system includes a chamber and a pressure riser with hydraulic oil on one side thereof and gas/liquid on the other. Pressure of the hydraulic oil always will be higher than the reservoir pressure, and the pressure in the hydraulic system is regulated automatically in relation to reservoir pressure at the depth to which the sampler device is immersed.

When opening the servo valve, which is connected and regulated by an electric motor, the pressure in the hydraulic chamber will open the slide valve in the lower end of the sampling device. When this valve opens, reservoir liquid will stream into the sample chamber in the sampling device and at the same time a counter pressure substance will, on the other side of a lead pipe, be removed to a chamber at atmospheric pressure. A pressure sensor continuously registers the pressure in this chamber and when this pressure equals the pressure in the reservoir, the sample chamber is filled. The servo valve again activates with the result that the slide valve closes a channel with an outlet to the reservoir and thus prevents leakage from the sample chamber when the assembly is hoisted to the surface.

BRIEF DESCRIPTION OF THE DRAWINGS

Other objects, features and advantages of the invention will be apparent from the following detailed description of the invention, with reference to the accompanying drawings, wherein.

DETAILED DESCRIPTION OF THE INVENTION

Figure 1:
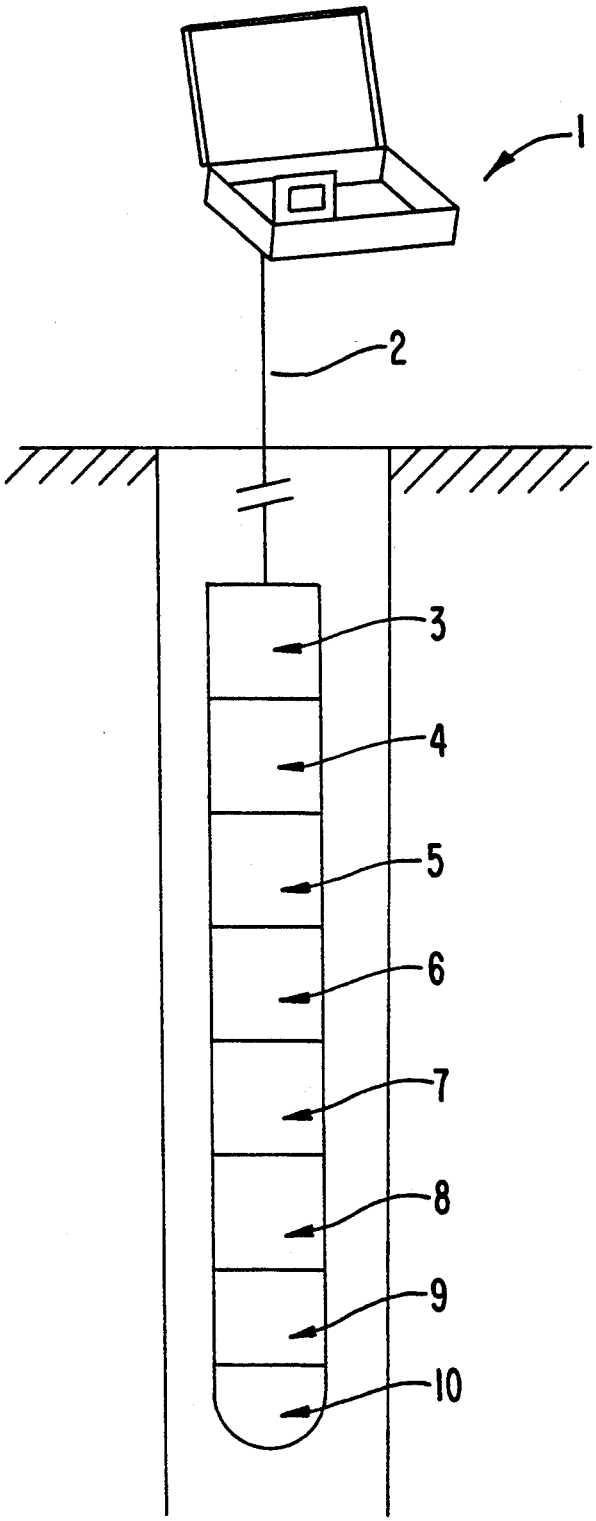
FIG. 1 is a schematic view of various elements of a deep well sampling assembly according to the invention.

FIG. 1 shows an overview of the assembly and the application of the sampling equipment according to the invention. A display and a steering or control panel 1 are placed above a ground surface. Through panel 1 an operator can choose which function is to be investigated. The operator can read pressure, temperature, permeability or, alternatively, depth within a well. Also, the panel is used for activating valves for filling of chambers and for storing data. Panel 1 is connected to the sampling device via a combined hoise and communication cable or wire 2 (monocable). The sampling device itself consists of several elements which together form a longitudinal cylindric pipe. An upper unit or part 3 of the sampling device includes a top part 11 for connection of the wire 2. Furthermore, the sampling device includes a unit 4 containing a permeability sensor 21 and a chamber 20 where electronic units for registration and analysis of sensor signals and thereupon control of the sampling device are located. A unit 5 has a DC motor 18 which controls a servo valve 19 in order to activate a hydraulic system for filling a sample chamber with reservoir liquid or gas, i.e. liquid or gas from the well. The hydraulic system includes a unit 6 which comprises a pressure riser or amplifier 22 which on one side has a chamber 23 containing hydraulic oil and on the other side a chamber 24 for reservoir liquid. In addition, the sampling device comprises a unit 7 with an atmospheric chamber 25. The lower part of the sampling device includes units 8, 9 and 10, where 8 contains a sampler 26 itself, 9 contains a slide valve 27 for opening and closing of a filler channel to the reservoir, and 10 includes a bottom part 28 that can be coupled to another top part 11 for alternative connection of another sampler.

Figure 2A:
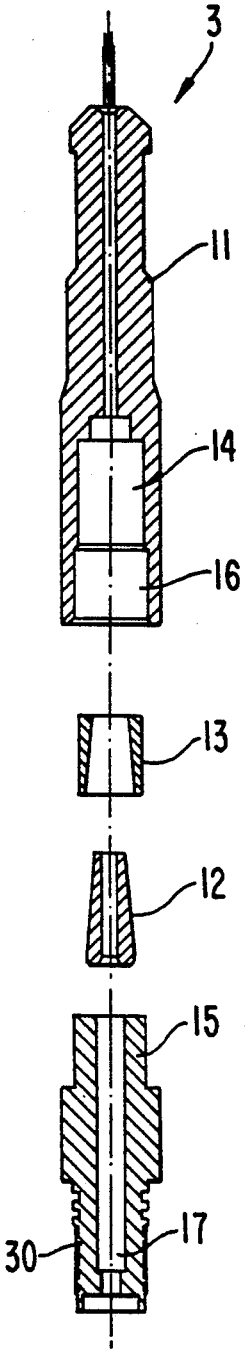
FIGS. 2*a*–2*f* are longitudinal sections of various such elements from the top to the bottom thereof as employed in a deep well.
Figure 2B:
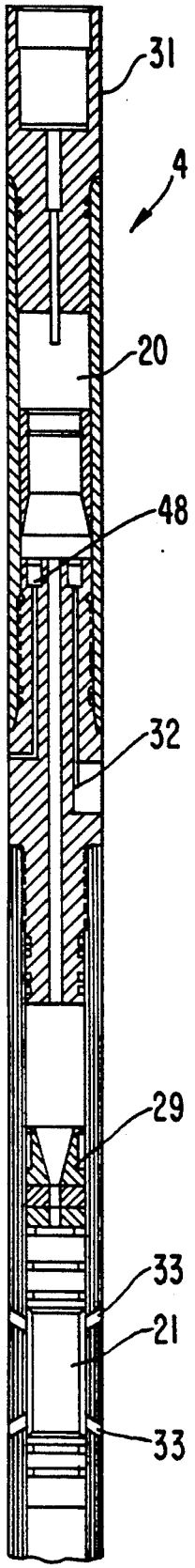
Figure 2C:
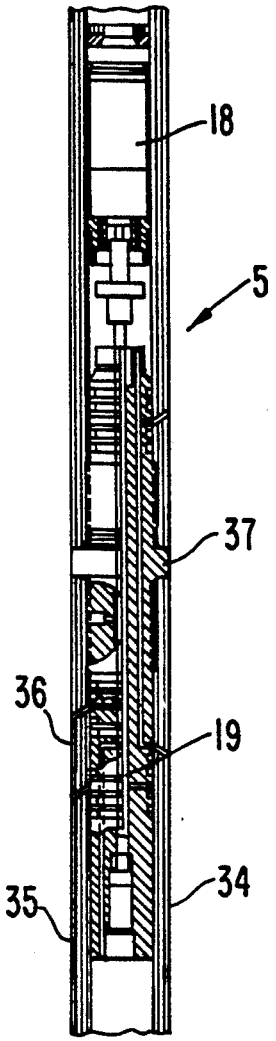
Figure 2D:
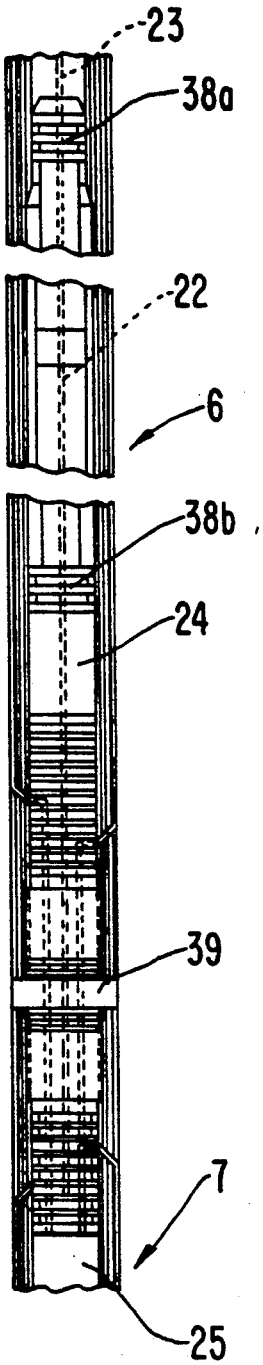
Figure 2E:
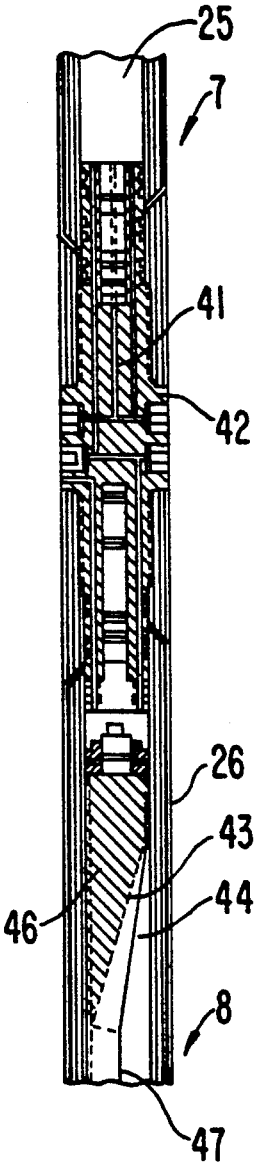
Figure 2F:
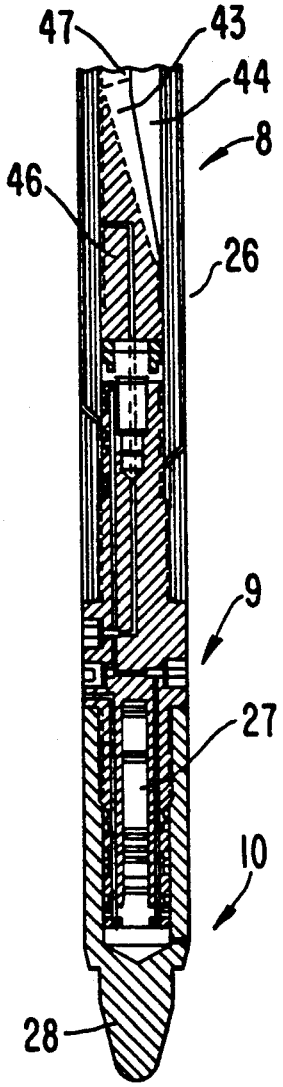

FIG. 2*a* shows how the cable 2 is to be connected to the deep well sampling device by guiding cable 2 through a cone 12 which locks around the cable when it is pressed upwards against a surrounding oppositely turned female cone 13. The cone 12 and the cone 13 are positioned in a chamber 14 of top part 11. A male member 15 then threads into female member 16. The cable extends downwardly through the sampling device via a channel 17 to the electronic chamber 20 of unit 4. Unit 4 includes a depth sensor 29. The depth sensor registers pipe joints of a pipe of the well while the deep well sampler device is being immersed into the well. Then, by counting the pipe joints, one can determine how deep the sampling device is located. The depth sensor operates in such a manner that a magnetic field is created when an electric current is transferred to the pipe. In this power field is placed a coil where voltage is induced. Every time a pipe joint is passed, a voltage charge is created because the pipe joint is thicker than the pipe wall. The charge is registered and amplified by an electronic unit located in chamber 20 and transferred via the cable 2 to the control panel 1. The lower part of unit 3 includes a male connector 30 for coupling to female connector 31 at the upper part of unit 4. Unit 4 includes, as described above, chamber 20 for the electronic components (not shown). In addition, it also includes a pressure sensor 48 which registers well pressure and a temperature sensor 32 which registers temperature in the reservoir. Permeability sensor 21 is provided in the lower part of unit 4.

The permeability sensor registers whether the deep well sampling device is surrounded by water, oil, gas or a mixture thereof. It functions by measuring capacitance with liquid as a dielectric. The capacitance changes with the type of liquid dielectric used when the electrical signal is transferred to the control panel. By statistical data one is then able to determine what type of liquid or gas is present. The electronic units in chamber 20 communicate with electronic units on panel 1. The system is built to transfer analog signals on channels for pressure, temperature, etc., and also in order to start and stop a DC motor 18 in unit 5. This is done via a two-way line in the wire 2 between the panel 1 and the sampling device.

In the control panel 1 there is a current source with a uniform voltage level. The current source is controlled by an amplifier in order to reach an optimal, or wanted, level. If one wants to investigate, for example, pressure or temperature, etc., this is done by a current pulsator in the well electronics which generates voltage charges (pulses) across resistors in the well electronics. These charges activate a comparator which, in turn, directs a multiplexer to seek out the wanted channel. The current will, in addition to passing resistors, also pass through zener diodes which stabilize the necessary operating voltage for the electronics. The analog signal generated from channels related to temperature or pressure, etc., is transformed to a digital signal by an AD transformer.

Reduction of the voltage level is achieved by keeping the current constant and varying the resistance. These pulses are sent to electronic units provided on shore where they are stored, decoded, analyzed and read. The pressure sensor 48 and the temperature sensor 32 for measuring the pressure and the temperature, respectively, are placed between the electronic chamber 20 and the permeability sensor 21. The permeability sensor functions in such a way that channels 3 transport a liquid stream from the reservoir, past the capacitator sensor, and then out again. Depending on which type of liquid is circulating the resulting measurements will change because oil, gas and water, or a combination thereof, have different dielectric properties. The measurements are thereafter compared with historical (statistical) data and interpreted on the basis thereof. The permeability sensor is very important in order to determine whether the sampling device is surrounded by oil, water or gas when a sample is taken.

The unit 5 includes electric DC motor 18 which is coupled to servo valve 19. The motor is regulated from the panel 1. The valve 19 regulates the opening/closing of the channels leading to the reservoir. By placing the valve 19 in an upper position, communication between channels 34 and 35 is open. Channel 34 transports hydraulic oil from the pressure riser of unit 6 through channel 35 and down to a lower part of the slide valve 27 which, in turn, opens for filling of oil/gas into the sample chamber. When the filling operation is completed, the polarity of the DC motor is reversed and the valve 19 is placed in a lower position. This results in closing of communication between channels 34 and 35 while the communication between channels 34 and 36 opens. Hydraulic oil will then move from chamber 23 through channels 34 and 36 down to the upper side of the slide valve 27. The channel leading to the reservoir will then close. This mechanism prevents leakage from the sample chamber. The parts 5 and 6 are coupled together by connection means 37. Part 6 comprises the pressure riser 22 where the chamber for hydraulic oil 23 is on one side of a piston 38*a* while the chamber 24 for the reservoir liquid is limited by a piston 38*b*. The ratio between the piston areas 38*b* and 38*b* is 1.15. Thus the hydraulic pressure will always be approximately 1.15 times higher than the reservoir pressure. As described above, it is the pressure from the reservoir which drives the hydraulic system.

The parts 6 and 7 are connected by connection means 39. Part 7 comprises only an atmospheric chamber 25 for receiving a counter pressure substance, e.g. hydraulic oil, when filling the sample chamber with reservoir liquid/gas. In the chamber 25 is provided a pressure sensor which registers the difference in pressure when chamber 25 is being filled. Simultaneously with collecting chamber 43 being filled, the chamber 25 is therefore equal to the reservoir pressure when the collecting chamber 43 is filled. The counter pressure substance is led through channel 41 in a connection means 42. Channel 41 ha a contraction device in order to lower the stream of counter pressure substance. The purpose is to prolong the sample filling time period in order to avoid evaporation or decomposition of components in the sample, which can occur if the pressure drops during filling.

In addition, the deep well sampling device includes unit 8 which includes sampler 26 containing the sample chamber 43 for liquid and gas. This type of sampling device 26, with a collecting chamber, is described in Norwegian patent application No. 895,139. A counter pressure substance is located in a chamber 44 and a liquid/gas sample in chamber 43. These two chambers are separated by a diffusion tight lead pipe which is connected to two cones 46. When the counter pressure chamber 44 is filled, for example with hydraulic oil, the lead pipe rests against a wedge 47 and the cones 46. When filling the sample chamber 43 with reservoir liquid the lead pipe is forced back to an original cylindrical shape thereof and at the same time the counter pressure substance is pressed out of chamber 44 and into chamber 26 at atmospheric pressure. At the lower part of unit 8 is provided slide valve 27 for opening/closing of the filling channel. This valve is governed by the hydraulic pressure from channel 34 or 35. Lower part 10 of the deep well sampling device includes bottom part 28 which is screwed onto an extension. Such extension can be used for coupling several sampling chambers to a sampling device. Thus, new units consisting of parts 7, 8, 9 and eventually bottom part 28, comprising an atmospheric chamber 26, a sampler 26 and slide valve 27 can be connected in series after one another when desired.

When sampling is done, the valves are closed and the sampling device is hoisted to the surface for transport, analysis, interpretation and storage.

Since the sampling device according to the invention is subjected to high temperatures during sampling operations, all components which might be damaged by such heat should be properly insulated by heat resistant material or other insulating means. In this connection it should be mentioned that a prototype was provided with a thermo bottle (not shown) in which all electronic components were disposed. Such thermo bottle proved to be sufficient to keep the heat out during sampling operations at high temperatures of 200° C.

We claim:

1. A deep well sampling assembly for taking and analysis of samples during drilling for or production of oil and gas, said assembly comprising:

a sampling device to be selectively inserted into and removed from a deep well, said sampling device including an openable and closeable sample chamber, a valve to open and close said sampling chamber so that a sample can be taken and retained therein, and a hydraulic system wholly contained within said sampling device to operate said valve;

a control panel to be located entirely above surface and including an electrical system to generate an electrical signal for actuation of said hydraulic system; and a combined hoist and electrical conducting cable joining said panel and said sampling device, and enabling said sampling device to be inserted into and removed from the deep well and providing selective communication of said electrical signal from said panel to said hydraulic system, to thereby enable said hydraulic system to operate said valve to take a sample.

2. An assembly as claimed in claim 1, wherein said hydraulic system includes an electric motor receiving said electrical signal, and a pump driven by said electric motor upon receipt thereby of said electrical signal.

3. An assembly as claimed in claim 1, wherein said hydraulic system includes a pressure riser.

4. An assembly as claimed in claim 3, wherein said pressure riser comprises a piston and cylinder arrangement including a first piston defining a first chamber receiving hydraulic fluid, and a second piston connected to said first piston and defining a second chamber communicable with a reservoir of oil/gas in the deep wall.

5. An assembly as claimed in claim 3, wherein said hydraulic system further includes a servo valve operable to regulate said pressure riser.

6. An assembly as claimed in claim 5, wherein said servo valve is operated by an electric motor.

7. An assembly as claimed in claim 1, wherein said hydraulic system includes a servo valve.

8. An assembly as claimed in claim 7, wherein said servo valve is operated by an electric motor.

9. An assembly as claimed in claim 1, wherein said sampling device further includes a throttle control to regulate velocity of filling of said sampling chamber.

* * * * *